US007221101B2

(12) United States Patent
Wey et al.

(10) Patent No.: US 7,221,101 B2
(45) Date of Patent: May 22, 2007

(54) LAMP DRIVING DEVICE

(75) Inventors: Chin-Der Wey, Houlong Township, Miaoli County (TW); Chia-Hung Sun, Kaohsiung (TW); Hsien-Jen Li, Hemei Township, Changhua County (TW); Yi-Chun Yen, Sanchong (TW)

(73) Assignee: AU Optronics Corp., Hsin-Chu (TW)

( * ) Notice: Subject to any disclaimer, the term of this patent is extended or adjusted under 35 U.S.C. 154(b) by 77 days.

(21) Appl. No.: 11/079,090

(22) Filed: Mar. 15, 2005

(65) Prior Publication Data

US 2006/0055337 A1 Mar. 16, 2006

(30) Foreign Application Priority Data

Sep. 15, 2004 (TW) ..... 93127941 A

(51) Int. Cl.
*H05B 37/02* (2006.01)

(52) U.S. Cl. ..... 315/224; 315/307; 315/308

(58) Field of Classification Search ..... 315/307, 315/308, 224

See application file for complete search history.

(56) References Cited

U.S. PATENT DOCUMENTS

| | | | | |
|---|---|---|---|---|
| 6,650,070 | B1 * | 11/2003 | Hudson et al. | 315/312 |
| 6,856,103 | B1 * | 2/2005 | Hudson et al. | 315/308 |
| 2003/0076054 | A1 * | 4/2003 | Bai | 315/224 |
| 2003/0142060 | A1 * | 7/2003 | Lee et al. | 345/102 |

* cited by examiner

*Primary Examiner*—David Vu
(74) *Attorney, Agent, or Firm*—Rabin & Berdo, P.C.

(57) ABSTRACT

A lamp driving device for driving a lamp. A feedback circuit includes a voltage falling unit and a rectification circuit. The voltage falling unit provides a low voltage signal in response to a first DC power signal, a first AC power signal or a first driving power signal. The rectification circuit rectifies the low voltage signal to generate a feedback signal. The rectification circuit provides the feedback signal. A controller provides a control signal in response to the feedback signal. A first DC-to-AC converter transforms the first DC power signal to the first AC power signal in response to the control signal. A first voltage raising unit raises the voltage of the first AC power signal to generate the first driving power signal. The first raising unit provides the first driving power signal to a first end of the lamp, so that the lamp achieves the desired brightness stably.

26 Claims, 10 Drawing Sheets

LAMP DRIVING DEVICE

This application claims the benefit of Taiwan application Serial No. 93127941, filed Sep. 15, 2004, the subject matter of which is incorporated herein by reference.

BACKGROUND OF THE INVENTION

1. Field of the Invention

The invention relates in general to a lamp driving circuit, and more particularly to a lamp driving circuit applied in a backlight module.

2. Description of the Related Art

Refer to FIG. 1A and FIG. 1B. FIG. 1A is a diagram of a conventional backlight module lamp driving circuit; FIG. 1B is a circuit diagram of a conventional feedback circuit. Liquid crystal display uses a fluorescent lamp 102 in a backlight module lamp driving circuit 100 as the backlight source to provide the light source during display. A conventional backlight module lamp driving circuit comprises a feedback circuit 104, a DC-to-AC converter 106, a voltage raising unit 108 and a controller 110. The feedback circuit 104 provides a feedback signal FSi in response to driving power signal PS required to drive the fluorescent lamp 102, so that the backlight module lamp driving circuit 100 adjusts the driving power signal PS for the fluorescent lamp 102 to achieve the desired brightness and maintain stability in response to the feedback signal FSi. The conventional feedback circuit 104, which is an ordinary rectification circuit, comprises diodes D1 and D2, a resistor R and a capacitor C, rectifies and filters the AC driving power signal PS, then provides the feedback signal FSi. When the rectification circuit corresponds to a small-sized liquid crystal display, the position of disposition, as illustrated in FIG. 1, can only be coupled to the fluorescent lamp 102 and the grounding end, or between the high voltage side coil of the voltage raising unit and the grounding end. Since the single end of the fluorescent lamp 102 is connected to the ground voltage, the feedback circuit 104 is serially connected to a low-voltage node.

As the size of liquid crystal display becomes larger and larger, the length of the fluorescent lamp 102 becomes longer and longer, and so too the striking and operating voltage of the fluorescent lamp 102 become higher. When the length of the fluorescent lamp 102 is over 900 mm, the required voltage of the fluorescent lamp 102 will be over 1.5 KV. So the lamp driving circuit 100 in the backlight module of a large-sized liquid crystal display has evolved from original single side drive mode to dual side drive mode, so that the two ends of the fluorescent lamp 102 will not have a low-voltage node. However, if a conventional feedback circuit 104 is used to convert the high voltage driving power signal PS into a feedback signal Fsi, the voltage of the feedback signal Fsi will be too high thus cannot be used by the controller 110 directly. Moreover, the elements of conventional feedback circuit 104 is too weak in terms of voltage resistance, so is unable to receive the high voltage driving power signal PS. Therefore, conventional feedback circuit 104 cannot be applied in the floating system backlight module 100.

SUMMARY OF THE INVENTION

It is therefore an object of the invention to provide a lamp driving circuit, and particularly to a lamp driving circuit of a feedback circuit which can be applied in a floating system backlight module and can receive a high voltage power signal to generate a feedback signal.

The invention achieves above-identified object by providing a lamp driving device for driving a lamp. The lamp driving device includes a controller, a first DC (direct current) to AC (alternating current) converter, a first voltage raising unit and a feedback circuit. The feedback circuit includes a voltage falling unit and a rectification circuit. The voltage falling unit provides a low voltage signal in response to a first DC power signal, a first AC power signal or a first driving power signal. The rectification circuit rectifies the low voltage signal to generate a feedback signal, and the rectification circuit provides the feedback signal. The controller provides a control signal in response to the feedback signal. The first DC to AC converter transforms the first DC power signal to the first AC power signal in response to the control signal. The first voltage raising unit raises the voltage of the first AC power signal to generate the first driving power signal. The first raising unit further provides the first driving power signal to a first end of the lamp, so that the lamp achieves the desired brightness stably.

Other objects, features, and advantages of the invention will become apparent from the following detailed description of the preferred but non-limiting embodiments. The following description is made with reference to accompanying drawings.

DETAILED DESCRIPTION OF THE INVENTION

Embodiment One

Figure 1A:
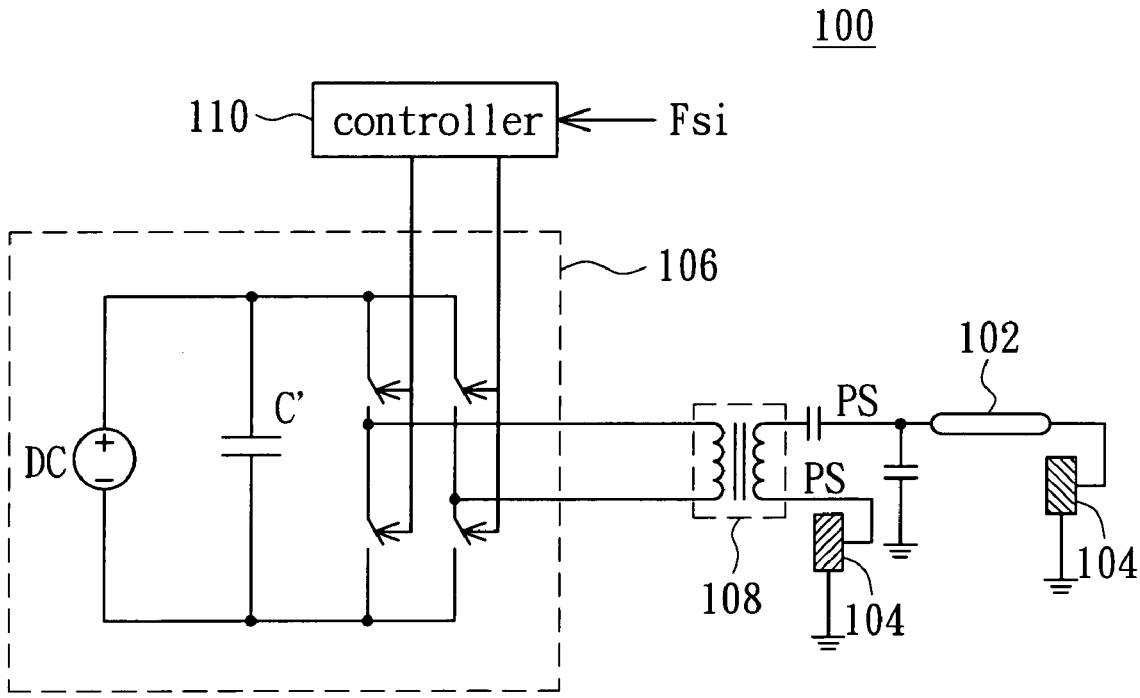
FIG. 1A(PRIOR ART)
FIG. 1A is a diagram of a conventional backlight module lamp driving circuit.
Figure 1B:
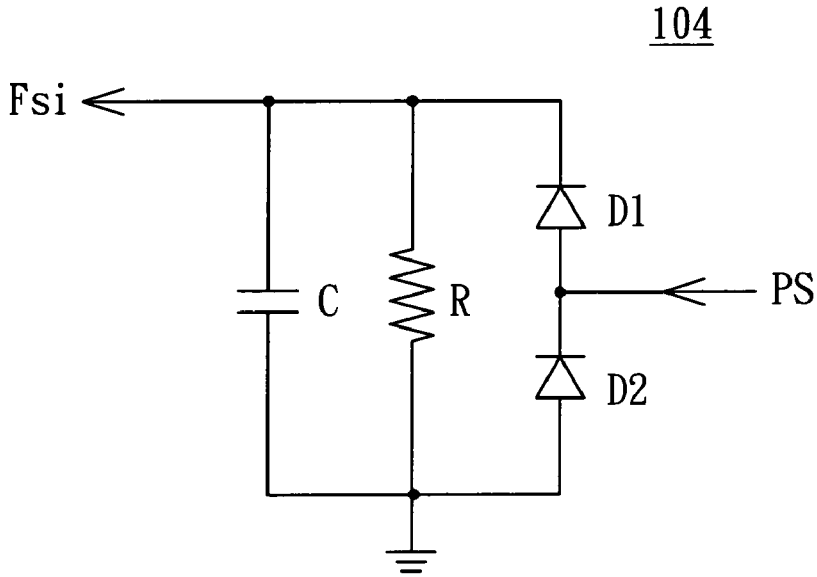
FIG. 1B(PRIOR ART)
FIG. 1B is a circuit diagram of a conventional feedback circuit.
Figure 2A:
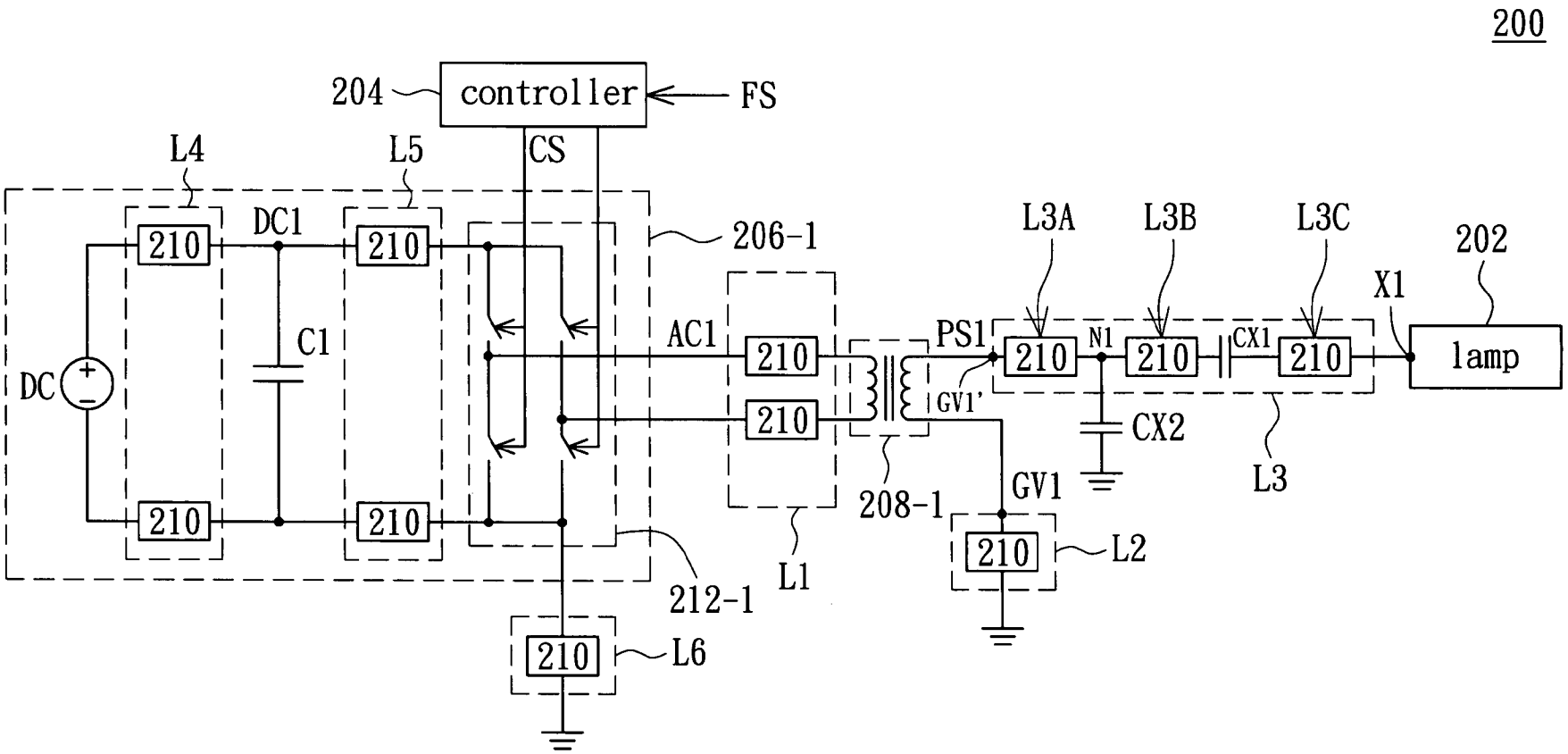
FIG. 2A is a circuit diagram of a lamp driving circuit according to the first embodiment of the invention.
Figure 2B:
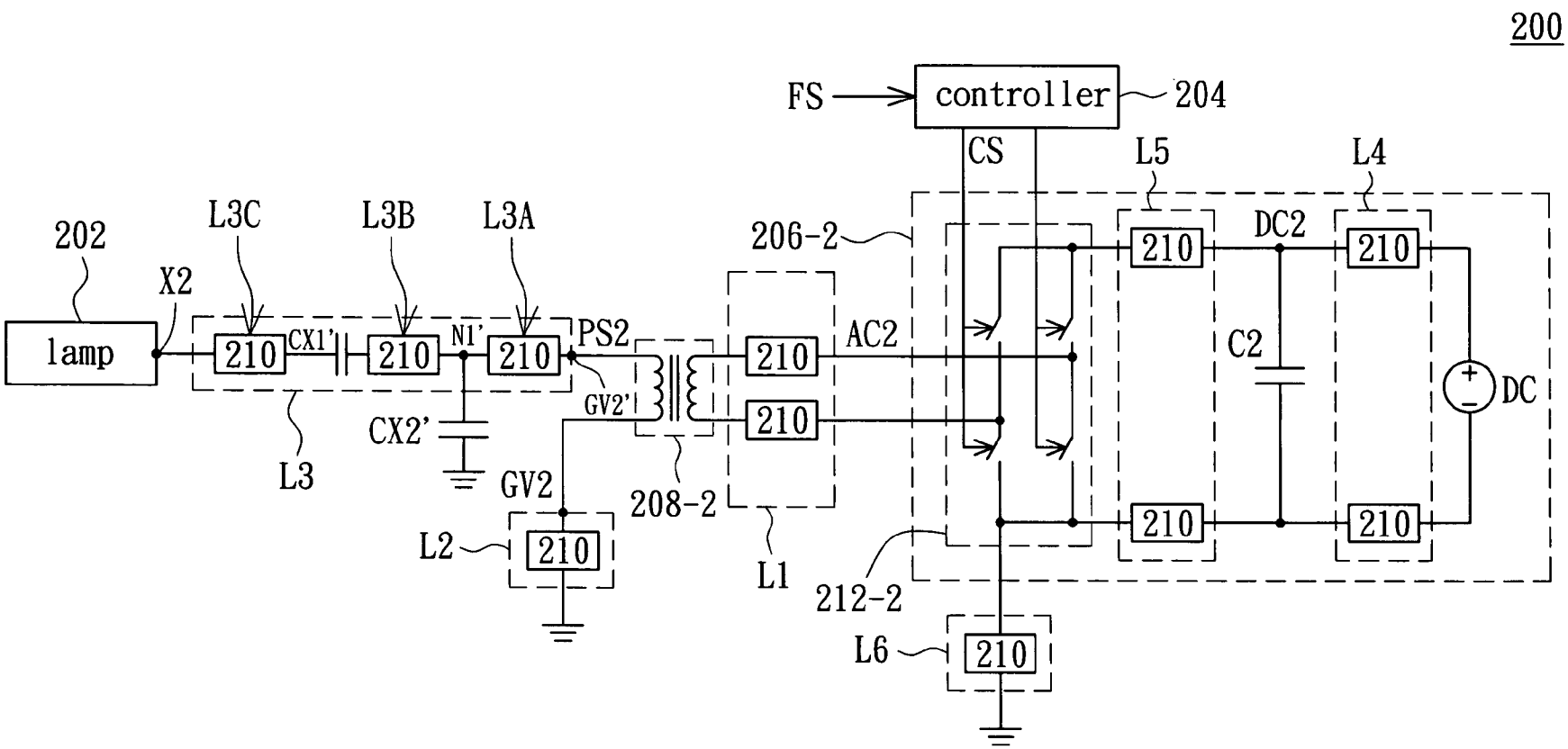
FIG. 2B a circuit diagram of a lamp driving circuit according to the first embodiment of the invention.

Referring to FIG. 2A and FIG. 2B, circuit diagrams of a lamp driving circuit according to a first embodiment of the invention are shown. Lamp driving circuit 200 is applied in a backlight module to drive a fluorescent lamp 202 as a backlight source. Since the drive mode of backlight module in a large-sized liquid crystal display has evolved from original single side drive to dual side drive mode, the circuits disposed on the two sides of the lamp driving circuit 200 are symmetric to the fluorescent lamp 202. The lamp driving circuit 200 comprises a controller 204, a first DC-to-AC converter 206-1 and a second DC-to-AC converter 206-2, a first voltage raising unit 208-1 and a second voltage raising unit 208-2, and a feedback circuit 210. The controller 204 provides the control signal CS in response to the feedback signal FS. The first DC-to-AC converter 206-1 and the second DC-to-AC converter 206-2 respectively comprise a switch unit, at least a capacitor such as a first capacitor C1 or a second capacitor C2, a first switch unit 212-1 and a second switch unit 212-2. The first DC power signal DC1 and the second DC power signal DC2 are respectively provided by corresponding DC power sources. The capacitors C1 and C2 respectively store the corresponding voltage of the first DC power signal DC1 and the second DC power signal DC2. The first switch unit 212-1 and the second switch unit 212-2 in response to the control signal CS respectively provide the first AC power signal AC1 and the second AC power signal AC2. The first AC power signal AC1 and the second AC power signal AC2 respectively correspond to the cross-voltage of the capacitors C1 and C2. Both he first voltage raising unit 208-1 and the second voltage raising unit 208-2 are converters, which respectively raise the voltage of the first AC power signal AC1 and the second AC power signal AC2, then the first voltage raising unit 208-1 provides the first driving power signal PS1 to the first end X1 of the fluorescent lamp 202, the second voltage raising unit 208-2 provides the second driving power signal PS2 to the second end X2 of the fluorescent lamp 202. The feedback circuit 210 is used to generate a feedback signal FS.

Due to the property of the component of a rectification circuit in a conventional feedback circuit, the voltage of the power signal received by the conventional feedback circuit cannot be too high, lest the voltage of the rectified feedback signal might be too high to the controller and the feedback circuit as well. Therefore the disposition of a conventional feedback circuit on a backlight module can only be between the fluorescent lamp and the grounding end, or between the high voltage side coil of a voltage raising unit and the grounding end.

The feedback circuit 210 of the invention comprises a voltage reduction unit 214 and a rectification circuit 216, wherein the voltage reduction unit 214 is series connected to the circuit, the voltage of the received power signal is appropriately reduced, then the power signal is transmitted to the rectification circuit 216 to be rectified and provided as a feedback signal FS. The disposition of the feedback circuit 210 on the lamp driving circuit is not limited to the position of the disposition of a conventional feedback circuit. The voltage reduction unit 214 can be a transformer or an operation amplifier circuit. The position of the two types is exemplified in FIG. 2A and FIG. 2B, wherein the first position L1, the second position L2 and the third position L3 represent the position that can be used when the voltage reduction unit is a transformer, while the first position L1, the second position L2, the third position L3, the fourth position L4, the fifth position L5 and the sixth position L6 represent the position that can be used when the voltage reduction unit is an amplifier.

Figure 3A:
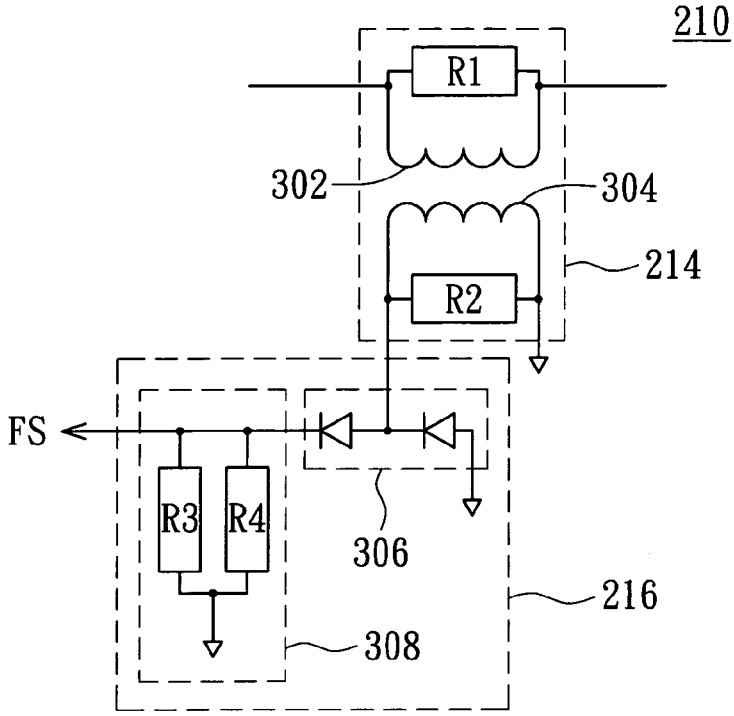
FIG. 3A is a circuit diagram of a feedback circuit according to the first embodiment of the invention.
Figure 3B:
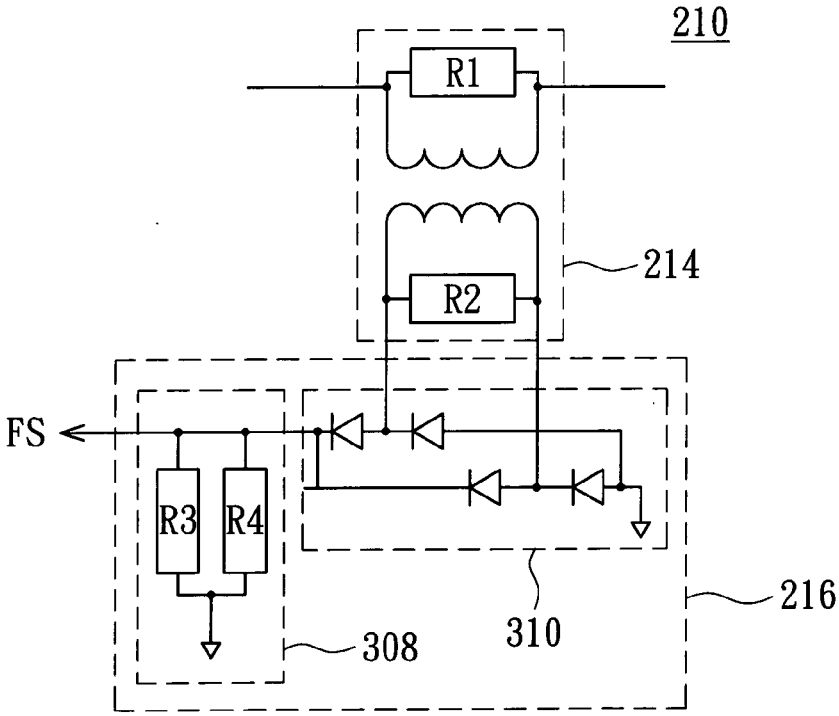
FIG. 3B is a circuit diagram of a feedback circuit according to the first embodiment of the invention.

Furthermore, when the voltage reduction unit 214 is a feedback circuit transformer, refer to FIG. 3A and FIG. 3B, circuit diagrams of a feedback circuit according to the first embodiment of the invention. The feedback circuit 210 comprises a voltage reduction unit 214 and a rectification circuit 216. The voltage reduction unit 214 comprises a feedback circuit high voltage side coil 302, a feedback circuit low voltage side coil 304, a first impedance unit R1 and a second impedance unit R2. The second impedance unit R2 and the low voltage side coil 304 are connected in parallel, and so too are the first impedance unit R1 and the high voltage side coil 302 connected in parallel, wherein the first impedance unit R1 and the second impedance unit R2 can be a capacitance, a resistance. Beside that, even the first impedance unit R1 or the second impedance unit R2 is omitted, the voltage reduction unit 214 can still work.

The feedback circuit transformer 214 transmits the received power signal to flow through the first impedance unit R1 so as to generate a corresponding voltage drop and reduce the voltage to a low voltage signal L. The feedback circuit transformer can only be operated under AC power signal, and can only receive AC power signal, so the power signal received by the feedback circuit transformer 214 can be a first AC power signal AC1, a second AC power signal AC2, a first driving power signal PS1 or a second driving power signal PS2. The rectification circuit 216 comprises a half-bridge rectification circuit 306 and a filtering circuit 308, wherein the half-bridge rectification circuit 306 rectifies and provides the low voltage signal L. The filtering circuit 308 comprises a third impedance unit R3 and a fourth impedance unit R4, wherein one end of the third impedance unit R3 and one end of the fourth impedance unit R4 are both coupled to a half-bridge rectification circuit 306, while the other end of the third impedance unit R3 and the other end of the fourth impedance unit R4 are both coupled to a constant voltage such as a ground voltage. The third impedance unit R3 and the fourth impedance unit R4 can be a resistance, a capacitance. The third impedance unit R3 or the fourth impedance unit R4 can also be omitted. The filtering circuit 308 filters the noise of the rectified low voltage signal L then provides a feedback signal FS. The half-bridge rectification circuit 306 can be a full-bridge rectification circuit 310 as shown in FIG. 3B. In FIG. 2A and FIG. 2B, the voltage reduction unit of the feedback circuit 210 is a transformer and can be disposed at the first position L1, the second position L2 or the third position L3. The details are exemplified below.

The first position L1 is the position in which some element can be coupled between the first DC-to-AC converter 206-1 and the first voltage raising unit 208-1 or between the second DC-to-AC converter 206-2 and the second voltage raising unit 208-2.

The second position L2 is the position in which some element can be coupled between the high voltage side coil end GV1 of the first voltage raising unit 208-1 and the ground voltage or between the high voltage side coil end GV2 of the second voltage raising unit 208-2 and the ground voltage.

The third position L3 is the position in which some element can be coupled between the first end X1 of the fluorescent lamp 202 and the high voltage side coil end GV1' of the first voltage raising unit 208-1 or between the second end X2 of the fluorescent lamp 202 and the high voltage side coil end GV2' of the second voltage raising unit 208-2. When a capacitor CX2 exists between the GV1' end and the X1 end, for example, one end of the capacitor CX2 is coupled to a node N1 while the other end of the capacitor CX2 is connected to the ground voltage, the third position L3 further comprises an L3A position in which some element can be coupled between the node N1 and the high voltage side coil end GV1' of the first voltage raising unit 208-1.

When a capacitor CX1 exists between the GV1' end and the X1 end, the third position L3 further comprises an L3B position in which some element can be coupled between the capacitor CX1 and the GV1' end, and an L3C coupled to the capacitor CX1 and the X1 end.

Similarly, when a capacitor CX2' or a capacitor CX1' exists between the second voltage raising unit 208-2 and the second end X2 of the fluorescent lamp 202, wherein the inter-space can be divided into L3A, L3B and L3C, and the feedback circuit 210 can be disposed at any position among L3A, L3B and L3C of the third position L3.

Figure 4:
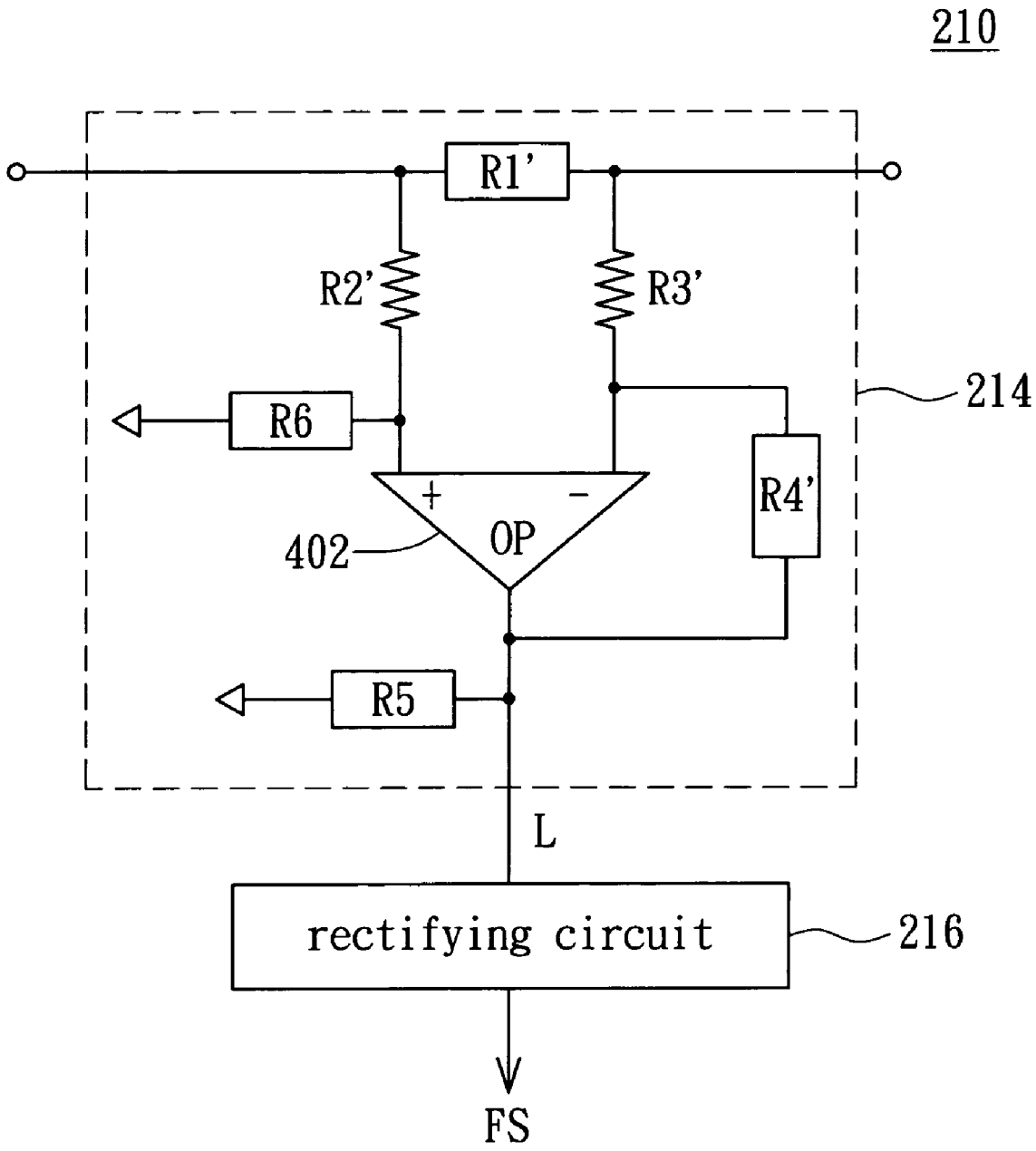
FIG. 4 is a circuit diagram of a feedback circuit according to a second embodiment of the invention.

Furthermore, when the voltage reduction unit 214 is an amplifier circuit, refer to FIG. 4, a circuit diagram of a feedback circuit according to the second embodiment of the invention is shown. The voltage reduction unit 214 comprises a first impedance unit R1', a second impedance unit R2', a third impedance unit R3', a fourth impedance unit R4', a fifth impedance unit R5, a sixth impedance unit R6 and an amplifier 402. The amplifier 402 has a positive input end, a negative input end and an output end, wherein the positive input end is coupled to one end of the first impedance unit R1' via second impedance unit R2', the negative input end is coupled to the other end of the first impedance unit R1' via the third impedance unit R3', and the fourth impedance unit R4' is coupled to the negative input end via the output end and provides a low voltage signal L accordingly. One end of the fifth impedance unit R5 is coupled to the output end, and the other end is coupled to a first constant voltage such as a ground voltage. One end of the sixth impedance unit R6 is coupled to the positive input end, and the other end is coupled to a second constant voltage such as a ground voltage. The first impedance unit R1', which can be a capacitance or a resistance, enables the power signal which flow through the first impedance unit R1' to generate corresponding voltage drop. The second impedance unit R2' and the third impedance unit R3' are both resistance. The fourth impedance unit R4' can be a resistance, a capacitance or a resistor-capacitance. The sixth impedance unit R6 can be a resistance or a capacitance. The fifth impedance unit R5 is a resistance, a capacitance. The fifth impedance unit R5 can also be omitted.

The amplifier circuit converts the corresponding voltage of the power signal flowing through the first impedance unit R1' to a low voltage signal L and transmits the low voltage signal L to rectification circuit 216. Since the amplifier circuit 214 can be operated under both AC and DC power signals, the power signal flowing through the first impedance unit R1' can be a first DC power signal DC1, a second DC power signal DC2, a first AC power signal AC1, a second AC power signal AC2, a first driving power signal PS1 or a second driving power signal PS2. The rectification circuit 216 receives the low voltage signal L and provides the feedback signal FS in response to the controller 204. The disposition of the feedback circuit 210 can be a first position L1, a second position L2, or a third position L3 as well as a fourth position L4, a fifth position L5 or a sixth position L6 as shown in FIG. 2.

The fourth position L4 is the position in which some element can be coupled between the DC power source of the first DC-to-AC converter 206-1 and the first capacitor C1, or between the DC power source of the second DC-to-AC converter 206-2 and the second capacitor C2.

The fifth position L5 is the position in which some element can be coupled between the first capacitor C1 and the first switch unit 212-1, or between the second capacitor C2 and the second switch unit 212-2.

The sixth position L6 is the position in which some element can be coupled between the first switch unit 212-1 and the grounding end, or between the second switch unit 212-2 and the grounding end, wherein the grounding end is coupled to ground voltage.

Figure 8:
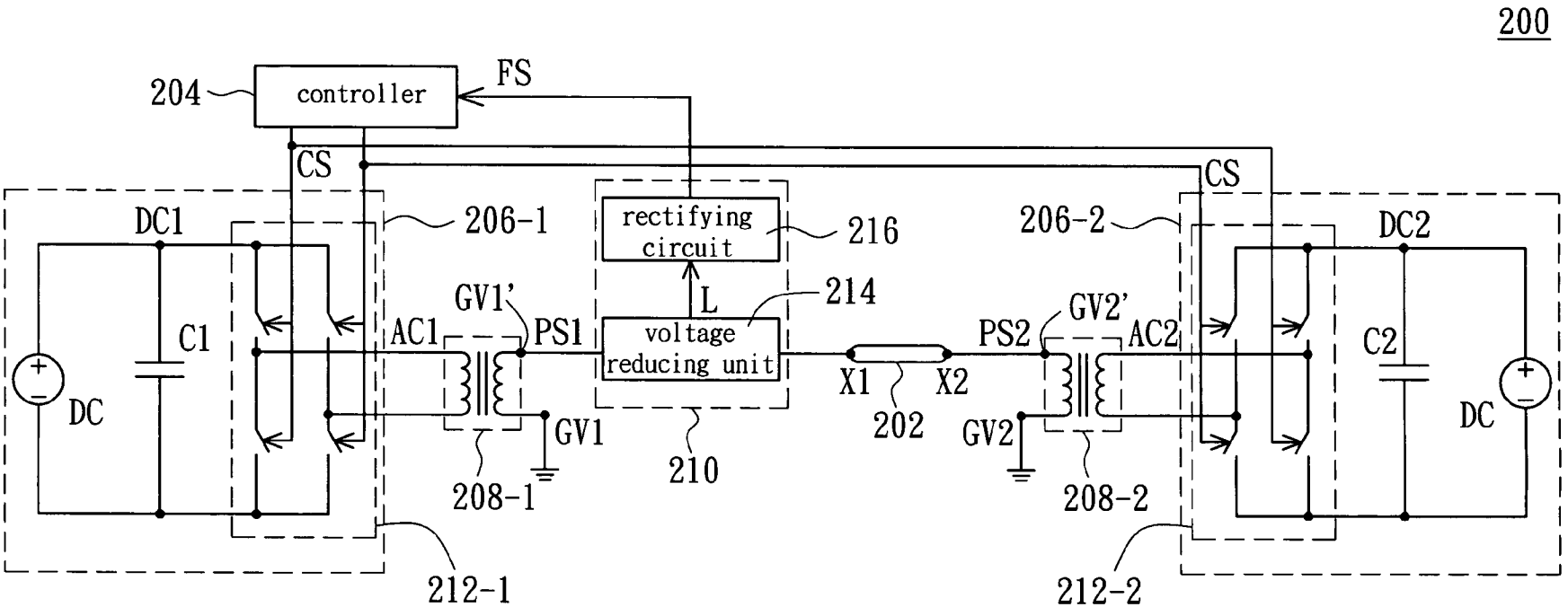
FIG. 8 is a circuit diagram of a preferred lamp driving circuit according to the invention.

Of the seven positions disclosed above, any position can generate a feedback signal FS to the controller 204 by means of a voltage reduction unit 214 and a rectification circuit 216, so that the controller 204 provides a control signal CS to control the brightness of the fluorescent lamp 202. Referring to FIG. 8, a circuit diagram of a preferred lamp driving circuit according to the invention is shown. The feedback circuit 210 is preferably disposed at the third position L3, the closer to the fluorescent lamp the better.

Figure 5A:
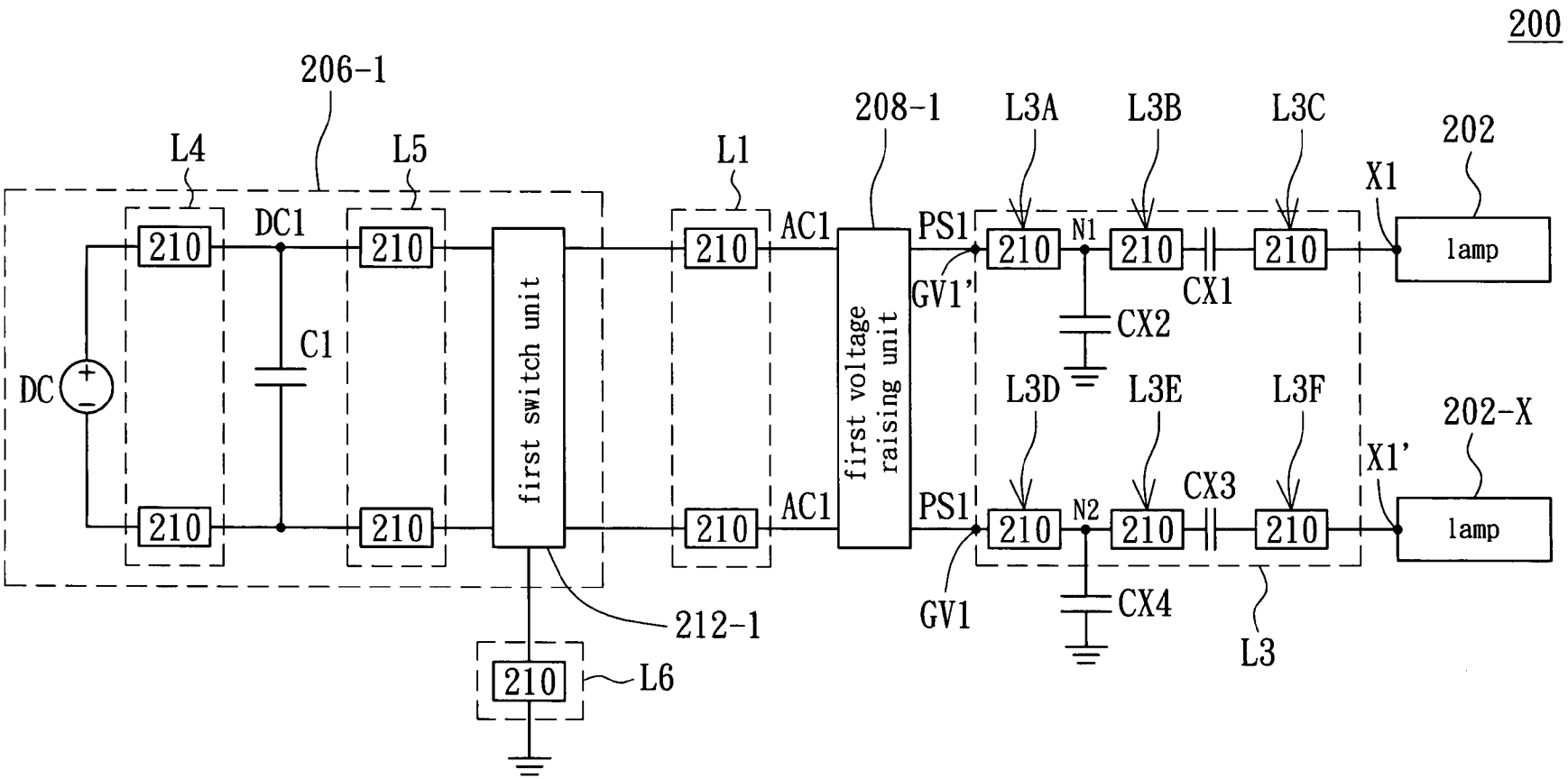
FIG. 5A is a circuit diagram of multi-lamp driving circuit.
Figure 5B:
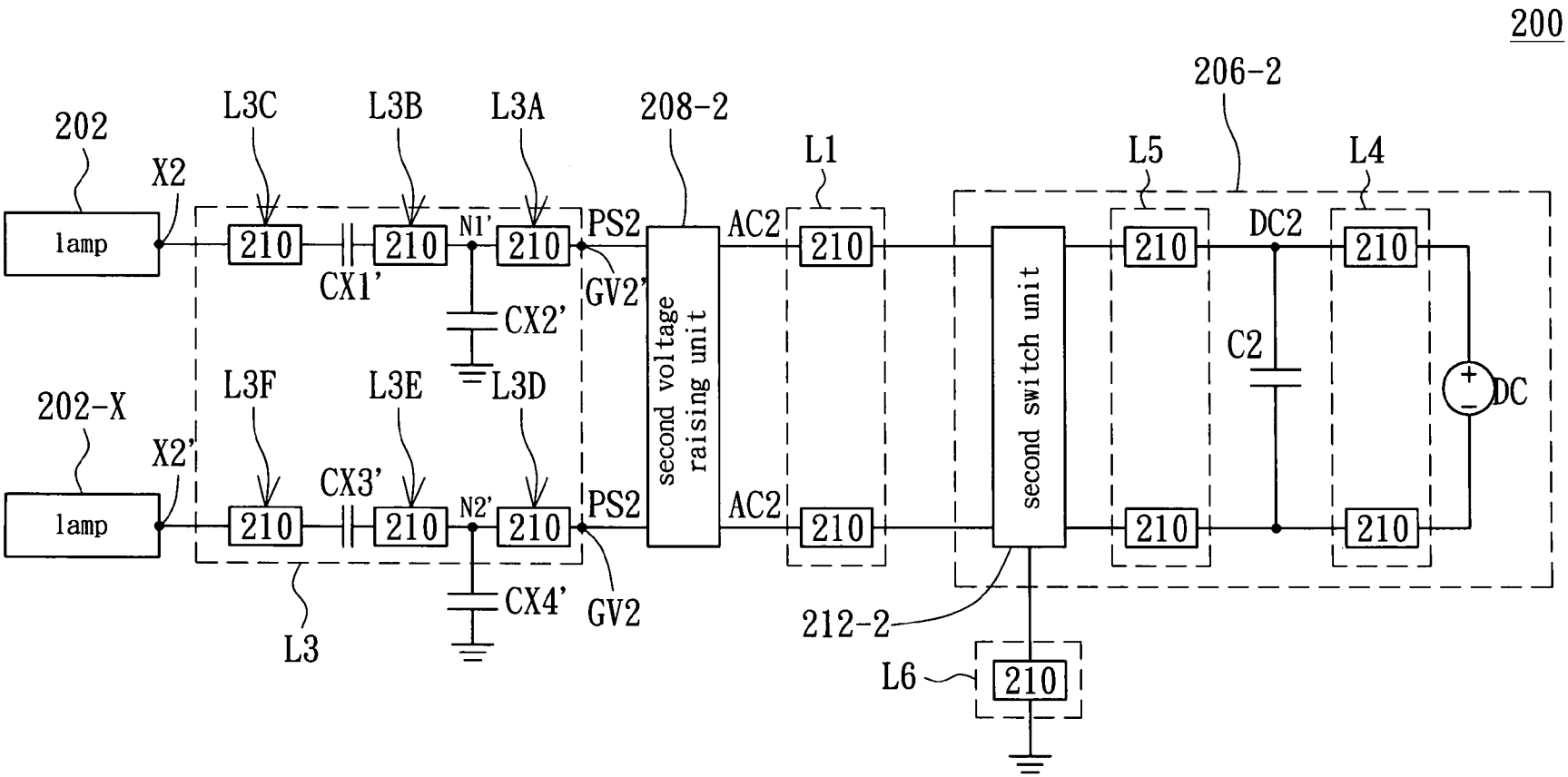
FIG. 5B is a circuit diagram of multi-lamp driving circuit.

Referring to FIG. 5A and FIG. 5B, circuit diagrams of multi-lamp driving circuit are shown. The lamp driving circuit 200 can further drive a plurality of fluorescent lamps such as fluorescent lamps 202 and 202-X. It can be seen from the diagram that, a feedback circuit 210 can be disposed between the ends X1' and X2' of the fluorescent lamp 202-X and the ends GV1 and GV2 of the two voltage raising units 208-1 and 208-2. Under such circumstance, disposition of the feedback circuit 210 can be any position of L3D, L3E, L3F apart from original L1, L3A, L3B, L3C, L4, L5, and L6.

Embodiment Two

Figure 6:
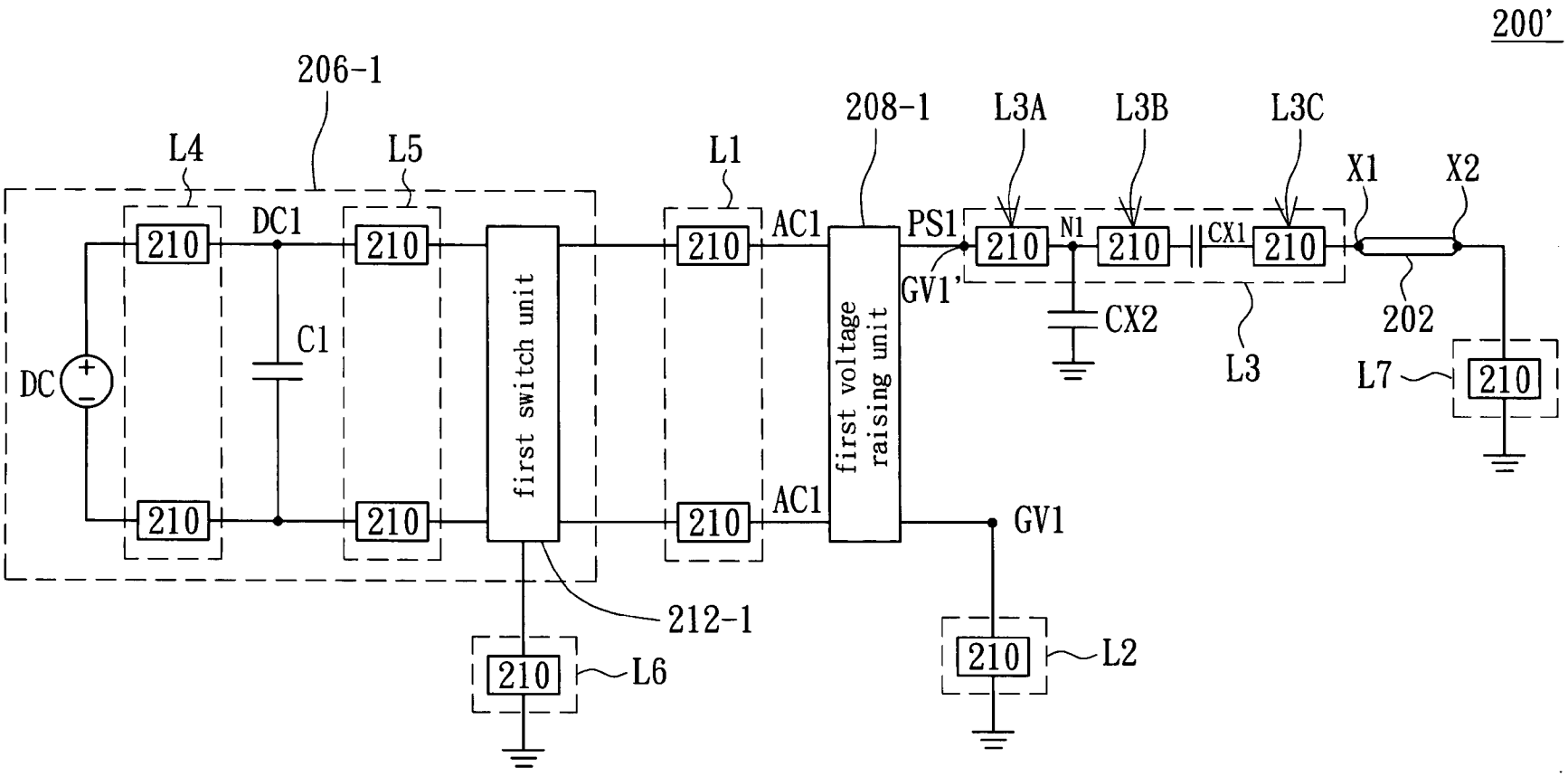
FIG. 6 is a circuit diagram of a lamp driving circuit according to the second embodiment of the invention.

Referring to FIG. 6, a circuit diagram of a lamp driving circuit according to a second embodiment of the invention is shown. The lamp driving circuit 200' changes from dual side drive mode to single side drive mode. That is to say, the lamp driving circuit 200' only comprises a controller 204, a first DC-to-AC converter 206-1, a first voltage raising unit 208-1 and a feedback circuit 210, wherein the first end X1 of the fluorescent lamp 202 receives the first driving power signal PS1, the second end X2 of the fluorescent lamp 202 is connected to a constant voltage, such as a ground voltage. The drive mode of the fluorescent lamp changes from dual side drive mode to single side drive mode, the principles of the method are the same and are not repeated here.

However, the spirit of the invention can be used to apply the voltage reduction unit 214 and the rectification circuit 216 to the multiple positions on the lamp driving circuit and use corresponding power signals to generate a feedback signal FS. When the voltage reduction unit 214 is a feedback circuit transformer, as shown in FIG. 3A and 3B, the position of the disposition of the feedback circuit 210 is the same with position L1~L3 in the first embodiment. Furthermore, by connecting the second single end X2 of the fluorescent lamp 202 to the round voltage, the feedback circuit 210 can further be disposed between the second single end X2 of the fluorescent lamp 202 and the grounding end, i.e., the seventh position L7, wherein the grounding end is coupled to the ground voltage.

When the voltage reduction unit 210 is an amplifier circuit as shown in FIG. 4 the disposition of the feedback circuit is the same with the positions L1~L6 in the first embodiment as well as and the seventh position L7 in the embodiment.

Figure 7:
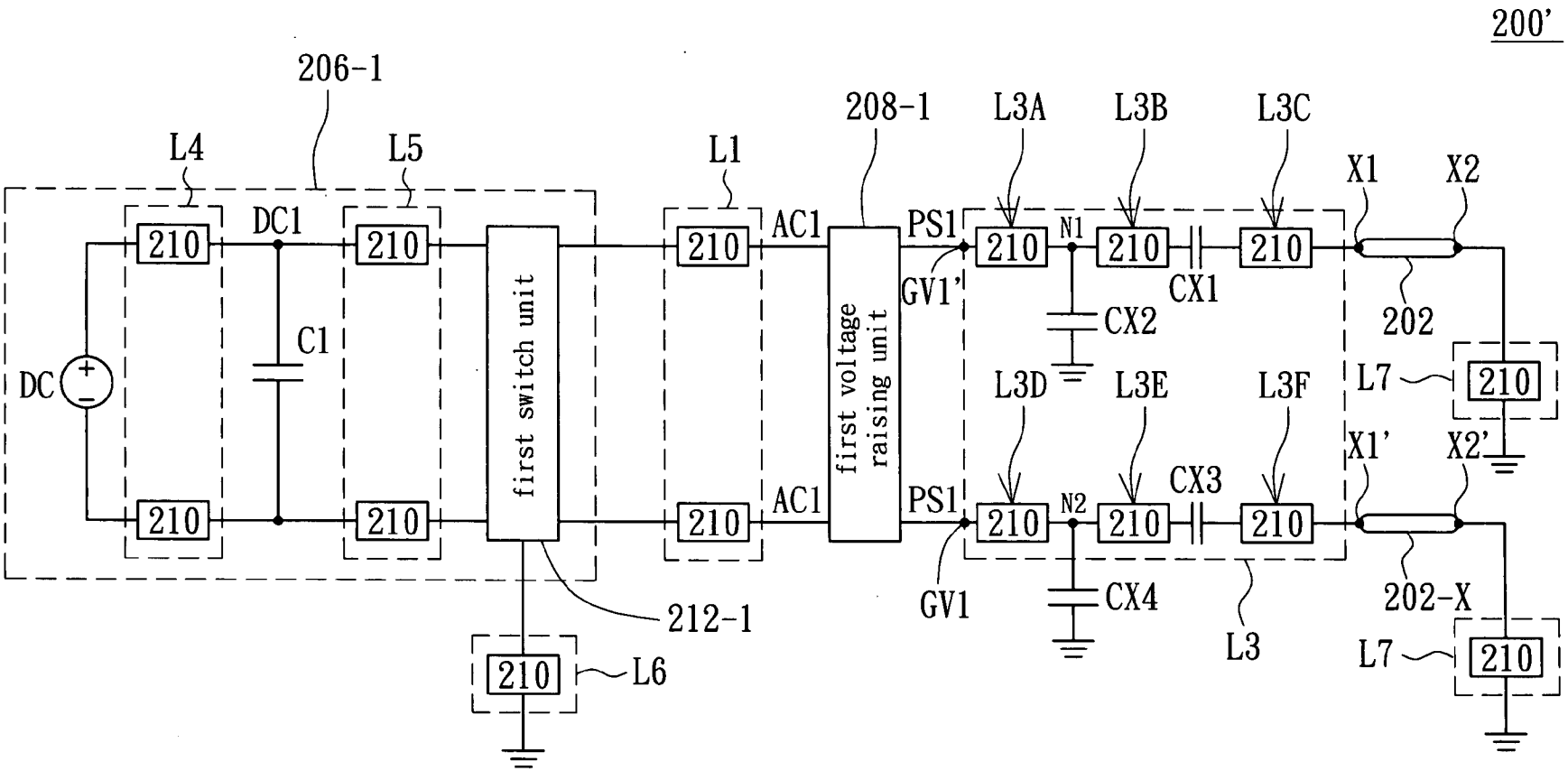
FIG. 7 is a circuit diagram of a single end driving circuit of multiple fluorescent lamps.

Besides, the lamp driving circuit of the present the embodiment can drive multiple fluorescent lamps such as a fluorescent lamp 202-X. Referring to FIG. 7, a circuit diagram of a single end driving circuit of multiple fluorescent lamps is shown. Similarly, according to the spirit of the invention, the feedback circuit 210 can also be disposed at the first position L1 and the third to the seventh position L3~L7, wherein the feedback circuit 210 is originally disposed at the second position L2, due to the high voltage side coil of the first voltage raising unit 208-1, the grounding end GV1 of the first voltage raising unit 208-1 is coupled to the first end X1' of the fluorescent lamp 202-X. Therefore, the third position L3 has three additional positions, namely, L3D, L3E and L3F.

When the electrical signal which is nearest to the fluorescent lamp is selected as the feedback signal, the lamp driving circuit disclosed in the above the embodiment of the invention can reduce the corresponding voltage of the first and the second driving power signal via an amplifier circuit or a feedback circuit transformer, so that the feedback circuit 210 can provide a feedback signal FS. Thus the difficulty encountered in obtaining a feedback signal when the driving voltage for the fluorescent lamp gets higher and higher.

While the invention has been described by way of example and in terms of a preferred embodiment, it is to be understood that the invention is not limited thereto. On the contrary, it is intended to cover various modifications and similar arrangements and procedures, and the scope of appended claims therefore should be accorded the broadest interpretation so as to encompass all such modifications and similar arrangements and procedures.

What is claimed is:

1. A device for driving at least one fluorescent lamp, comprising:

a controller for providing a control signal in response to a feedback signal;

a first DC-to-AC converter for converting a first DC power signal into a first AC power signal in response to the control signal;

a first voltage raising unit for raising the voltage of the first AC power signal and providing a first driving power signal to a first end of the at least one fluorescent lamp; and a feedback circuit, comprising:

a voltage reduction unit for providing a low voltage signal in response to the first DC power signal, the first AC power signal, or the first driving power signal; and a rectification circuit for rectifying the low voltage signal and providing the feedback signal.

2. The device according to claim 1, further comprising:

a second DC-to-AC converter for converting a second DC power signal into a second AC power signal in response to the control signal; and a second voltage raising unit for raising the voltage of the second AC power signal and providing a second driving power signal to a second end of the at least one fluorescent lamp.

3. The device according to claim 1, wherein the feedback circuit is coupled to the first end of one of the at least one fluorescent lamp and the first voltage raising unit.

4. The device according to claim 1, wherein the first voltage raising unit comprises a transformer, and the high voltage side coil of the first voltage raising unit is coupled to a constant voltage via the feedback circuit.

5. The device according to claim 1, wherein the feedback circuit is coupled to the first DC-to-AC converter and the first voltage raising unit.

6. The device according to claim 1, wherein the second end of the at least one fluorescent lamp is coupled to a constant voltage.

7. The device according to claim 6, wherein the second end of one of the at least one fluorescent lamp is coupled to a constant voltage via the feedback circuit, and the feedback circuit generates the feedback signal in response to the first driving power.

8. The device according to claim 1, wherein the voltage reduction unit comprises a feedback circuit transformer, and the feedback circuit transformer converts the voltage corresponding to the first AC power signal or the first driving power signal into the low voltage signal.

9. The device according to claim 8, wherein the feedback circuit transformer comprises a feedback circuit high voltage side coil, a feedback circuit low voltage side coil, a first impedance unit and a second impedance unit, the first impedance unit and the high voltage side coil are connected in parallel, the second impedance unit and the low voltage side coil are connected in parallel.

10. The device according to claim 1, wherein the rectification circuit comprises:

a full-bridge rectification circuit for rectifying and providing the low voltage signal;

a filter for filtering the noise of the rectified low voltage signal and providing the feedback signal.

11. The device according to claim 10, wherein the filter comprises a capacitor or a resistor.

12. The device according to claim 1, wherein the rectification circuit comprises:

a half-bridge rectification circuit for rectifying the low voltage signal;

a filter for filtering the rectified low voltage signal and providing the feedback signal.

13. The device according to claim 10, wherein the filter comprises a capacitor or a resistor.

14. The device according to claim 1, wherein the voltage reduction unit comprises an amplifier circuit, and the amplifier circuit converts the voltage corresponding to the first DC power signal, the first AC power signal or the first driving power signal into the low voltage signal.

15. The device according to claim 14, wherein the amplifier circuit comprises:

a first impedance unit for receiving the first driving power signal, the first DC power signal, or the first AC power signal;

a second impedance unit;

a third impedance unit;

a fourth impedance unit;

an amplifier for providing the low voltage signal, wherein the amplifier has a positive input end, a negative input end and an output end, the positive input end is coupled to one end of the first impedance unit via the second impedance unit, the negative input end is coupled to the other end of the first impedance unit via the third impedance unit, and the output end is coupled to the negative input end via the fourth impedance unit;

a fifth impedance unit whose one end is coupled to the output end and the other end is adapted to coupled to a first constant voltage; and a sixth impedance unit whose one end is coupled to the positive input end and the other end is adapted to couple to a second constant voltage.

16. The device according to claim 15, wherein the first impedance unit comprises a capacitor or a resistor.

17. The device according to claim 15, wherein the fourth impedance unit comprises a resistor.

18. The device according to claim 17, wherein the first DC-to-AC converter comprises:

at least one capacitor for storing the voltage of the first DC power signal, wherein the first DC power signal is provided by a DC power source; and a switch unit for selectively providing the first AC power signal corresponding to the cross-voltage of the capacitor;

wherein the feedback circuit is coupled to the DC power source and the capacitor, the capacitor and the switch unit, or the switch unit and a grounding node.

19. A feedback circuit for a lamp driving circuit configured to drive at least a fluorescent lamp in response to a feedback signal, comprising:

a voltage reduction unit coupled to a position of the lamp driving circuit, wherein the voltage reduction unit comprises a feedback circuit transformer for converting a power signal of the position into a low voltage signal, and the feedback circuit transformer comprises:

a feedback circuit high voltage side coil;

a feedback circuit low voltage side coil;

a first impedance unit, wherein the first impedance unit and the high voltage side coil are connected in parallel; and a second impedance unit, wherein the second impedance unit and the low voltage side coil are connected in parallel; and a rectification circuit for rectifying and providing the low voltage signal to the feedback signal.

20. The feedback circuit according to claim 19, wherein the rectification circuit comprises:

a full-bridge rectification circuit for rectifying and provides the low voltage signal;

a filter for filtering the rectified low voltage signal and providing the feedback signal.

21. The device according to claim 20, wherein the filter comprises a capacitor or a resistor.

22. The feedback circuit according to claim 19, wherein the rectification circuit comprises:

a half-bridge rectification circuit for rectifying and providing the low voltage signal;

a filter for filtering the rectified low voltage signal and providing the feedback signal.

23. The device according to claim 22, wherein the filter comprises a capacitor or a resistor.

24. A feedback circuit for a lamp driving circuit configured to drive at least a fluorescent lamp in response to a feedback signal, comprising:

a voltage reduction unit coupled to a position of the lamp driving circuit, wherein the voltage reduction unit comprises an amplifier circuit for converting a power signal of the position into a low voltage signal, and the amplifier circuit comprises:

a first impedance unit for receiving a first driving power signal, a first DC power signal or a first AC power signal of the power signal;

a second impedance unit;

a third impedance unit;

a fourth impedance unit;

an amplifier for providing the low voltage signal, wherein the amplifier has a positive input end, a negative input end and an output end, the positive input end is coupled to one end of the first impedance unit via the second impedance unit, the negative input end is coupled to the other end of the first impedance unit via the third impedance unit, and the output end is coupled to the negative input end via the fourth impedance unit;

a fifth impedance unit whose one end is coupled to the output end and the other end is adapted to coupled to a first constant voltage; and a sixth impedance unit whose one end is coupled to the positive input end and the other end is coupled to a second constant voltage; and a rectification circuit for rectifying and providing the low voltage signal to the feedback signal.

25. The device according to claim 24, wherein the first impedance unit comprises a capacitor or a resistor.

26. The device according to claim 24, wherein the fourth impedance unit comprises a resistor.

* * * * *